US012109501B2

(12) United States Patent
Rokah

(10) Patent No.: US 12,109,501 B2
(45) Date of Patent: Oct. 8, 2024

(54) BOARD GAME APPARATUS AND METHOD THEREFOR

(71) Applicant: Reuven Rokah, Oranit (IL)

(72) Inventor: Reuven Rokah, Oranit (IL)

( * ) Notice: Subject to any disclaimer, the term of this patent is extended or adjusted under 35 U.S.C. 154(b) by 466 days.

(21) Appl. No.: 17/498,777

(22) Filed: Oct. 12, 2021

(65) Prior Publication Data

US 2022/0023750 A1 Jan. 27, 2022

Related U.S. Application Data

(63) Continuation-in-part of application No. PCT/IL2020/050422, filed on Apr. 7, 2020.

(30) Foreign Application Priority Data

Apr. 18, 2019 (IL) ..... 266129

(51) Int. Cl.
*A63F 3/00* (2006.01)
*A63F 11/00* (2006.01)

(52) U.S. Cl.
CPC ..... *A63F 3/00697* (2013.01); *A63F 11/0025* (2013.01); *A63F 2003/00835* (2013.01); *A63F 2011/0048* (2013.01)

(58) Field of Classification Search
CPC ..... A63F 3/00; A63F 3/00697; A63F 2003/00899; A63F 2003/00911; A63F 2003/00933; A63F 7/00; A63F 7/0076; A63F 11/0025; A63F 2003/00835; A63F 2011/0048
See application file for complete search history.

(56) References Cited

U.S. PATENT DOCUMENTS 1,600,727 A * 9/1926 Gates ..... A63F 7/0076 273/109
1,674,681 A * 6/1928 Brenkert ..... A63F 7/044 273/115
2,581,644 A 1/1952 Frick
3,108,808 A * 10/1963 Peterson ..... A63F 7/00 273/357

(Continued)

FOREIGN PATENT DOCUMENTS

EP 1716894 A1 * 11/2006 ..... A63F 3/00
EP 2529802 A1 * 12/2012 ..... A63F 3/00094

(Continued)

OTHER PUBLICATIONS

International Search Report for PCT/IL2020/050422, mailed on Jun. 21, 2020; 3 pages.

(Continued)

*Primary Examiner* — Raleigh W Chiu
(74) *Attorney, Agent, or Firm* — Roach Brown McCarthy & Gruber, P.C.; Kevin D. McCarthy

(57) ABSTRACT

A board game apparatus has a dented platform, a transparent guiding tube, and an applicator. The dented platform has a plurality of dents. The dents are adapted to receive corresponding game pieces. And each dent is adapted to accommodate a single game piece. The transparent guiding tube and the applicator are adapted for placing the game pieces into desirable dents, or for shifting the position of a game piece between dents.

15 Claims, 6 Drawing Sheets

(56) References Cited

U.S. PATENT DOCUMENTS 3,679,211 A * 7/1972 Hartley ..... A63F 7/0076 273/144 B
3,888,487 A * 6/1975 Replogle ..... A63F 3/00094 273/288
3,994,498 A * 11/1976 Breslow ..... A63F 7/0076 273/340
4,066,263 A * 1/1978 Balas ..... A63F 7/00 273/287
4,953,874 A * 9/1990 Golomb ..... A63F 7/0076 434/327
5,184,829 A * 2/1993 Njaka ..... A63F 3/00574 273/242
5,201,524 A * 4/1993 Csanady ..... A63F 7/0076 273/287
5,560,616 A 10/1996 Van Hessen
2007/0114719 A1* 5/2007 Floden ..... A63F 3/00082 273/258
2008/0108274 A1* 5/2008 Cheng ..... A63F 3/00 446/120
2013/0119607 A1* 5/2013 Neuvirth ..... A63F 3/00176 273/242
2014/0265120 A1* 9/2014 Elwell ..... A63F 7/0023 273/242
2017/0266540 A1* 9/2017 Cluck ..... A63F 3/00697
2018/0290051 A1* 10/2018 Hedgecock ..... A63F 3/0423

FOREIGN PATENT DOCUMENTS

FR 2445158 A1 * 7/1980 ..... A63F 5/00
GB 2420508 A * 5/2006 ..... A63F 7/0023
WO WO-2020212974 A1 * 10/2020 ..... A63F 11/0025

OTHER PUBLICATIONS

International Preliminary Report On Patentability for PCT/IL2020/050422, mailed on May 19, 2021; 7 pages.
Written Opinion of the International Searching Authority for PCT/IL2020/050422, mailed on Jun. 21, 2020; 6 pages.

* cited by examiner

BOARD GAME APPARATUS AND METHOD THEREFOR

FIELD OF THE INVENTION

The present invention is in the field of multi-player board games. More particularly, the invention relates to a multi-player skill game apparatus.

BACKGROUND OF THE INVENTION

The significant contribution of gaming to children's cognitive, social and physical development is broadly acknowledged. A similarly known contribution is acknowledged for adults and elders who can utilize the advantageous game playing for maintaining and improving their skills.

Since the early years of personal computing, multiplying interactive games are introduced to computer users. The different computer games introduce new challenges and new skills, which many times correspond to skills which are required for the operation of new appliances and technical devices (e.g., playing aircraft simulation games with respect to flying real drones). The introduction and development of game consoles mobile devices and applications therefor (e.g., smartphones and tablets) have even a greater impact.

With the above mentioned later gaming arenas rapidly expanding, the traditional board gaming arena has lost its popularity to computer games. In many aspects computer games can encourage cognitive skills (e.g., simulated board games, various quest and strategy games), motor skills (e.g., using control devices such as joysticks or games in which the players has to perform actual physical gestures which are captured by computer cameras, pressure sensing devices etc.) and even social skills (e.g., playing multi-player network games).

Nevertheless some skills which are well supported by tangible games, such as direct interpersonal communication, hand-eye coordination, fine motor skills and other physical skills are not encouraged by computer games. Furthermore, while most tangible games are accessible to a wider range of ages including toddlers, children adults and elders, hence encourage inter-generation quality time, current popular computer games are many times accessible only to children and teenagers.

It is an object of the present invention to provide a challenging tangible game that encourages the utilization, hence the development, of multiple cognitive, social and fine motor skills.

It is another object of the present invention to provide a game which is accessible to players of multiple age layers.

Other objects and advantages of the invention will become apparent as the description proceeds.

SUMMARY OF THE INVENTION

A board game apparatus, comprising:

a dented platform having a plurality of dents that are adapted to receive corresponding game pieces, wherein each dent adapted to accommodate a single game piece; and manipulating means adapted for placing said game pieces into desirable dents, or for shifting the position of a game piece between dents.

According to an embodiment of the invention, the platform is essentially round and flat.

According to an embodiment of the invention, the dents are half-spherical.

According to an embodiment of the invention, the game pieces are spherical marbles.

According to an embodiment of the invention, the marbles are distinguished by different colors, thus each player receives game pieces at a different color.

According to an embodiment of the invention, the dented platform comprises a base in which said dented platform is rotatable with respect to said base. For example, a ball bearing is utilized to enable a relative rotation of the dented platform with respect to the base.

According to an embodiment of the invention, the manipulating means comprises a transparent guiding tube and an applicator that is adapted to be inserted through said transparent guiding tube in order to place the game pieces into desirable dents, or to shift the position of a game piece between dents.

According to an embodiment of the invention, the applicator comprises a first tip of a curved thin design and a second tip of a concave ring design.

According to an embodiment of the invention, the transparent guiding tube comprises a first port of a straight cylindrical ending and a second port of a diagonal cylindrical ending.

According to an embodiment of the invention, the apparatus further comprises one or more containers for storing the game pieces.

According to an embodiment of the invention, a suitable ending port of the transparent guiding tube is inserted first into the confined space for providing elongated securement of a traveling game piece when a target placement dent is distant from the center of the game platform.

According to an embodiment of the invention, the apparatus further comprises a transparent dome with an opening at its vertex that is adapted to cover the dented platform and to enable the insertion of game pieces into the confined space between the dented platform and said transparent dome through said opening by using the manipulation means, for placing the game pieces into desirable dents, or for shifting the position of a game piece between dents.

According to an embodiment of the invention, the apparatus further comprises a central pillar with rotating ring for supporting the manipulating means for enabling the placing of game pieces into desirable dents, or for shifting the position of a game piece between dents.

In another aspect, the present invention relates to a method for inserting game pieces into a viewable confined space and placing said game pieces into corresponding dents by using manipulating means, wherein the dents are embedded within a game platform.

DETAILED DESCRIPTION OF THE DRAWINGS

The present invention relates to a board game, in which the board is a dented platform, covered with a transparent cover comprising an opening at its vertex, through which manipulating means can be inserted to allow the manipulating of game pieces (e.g., insertion of game pieces into the confined space and placement onto platform dents, or shifting the position of game pieces between dents) within the confined space. According to an embodiment of the invention, a player has to keep a marble nested on a tip of an applicator (which is part of the manipulation means) until reaching near a desired target dent without touching any marble already placed in dents. This is performed by cautiously swiveling the applicator inside a tube while directing both towards the target dent.

Figure 1:
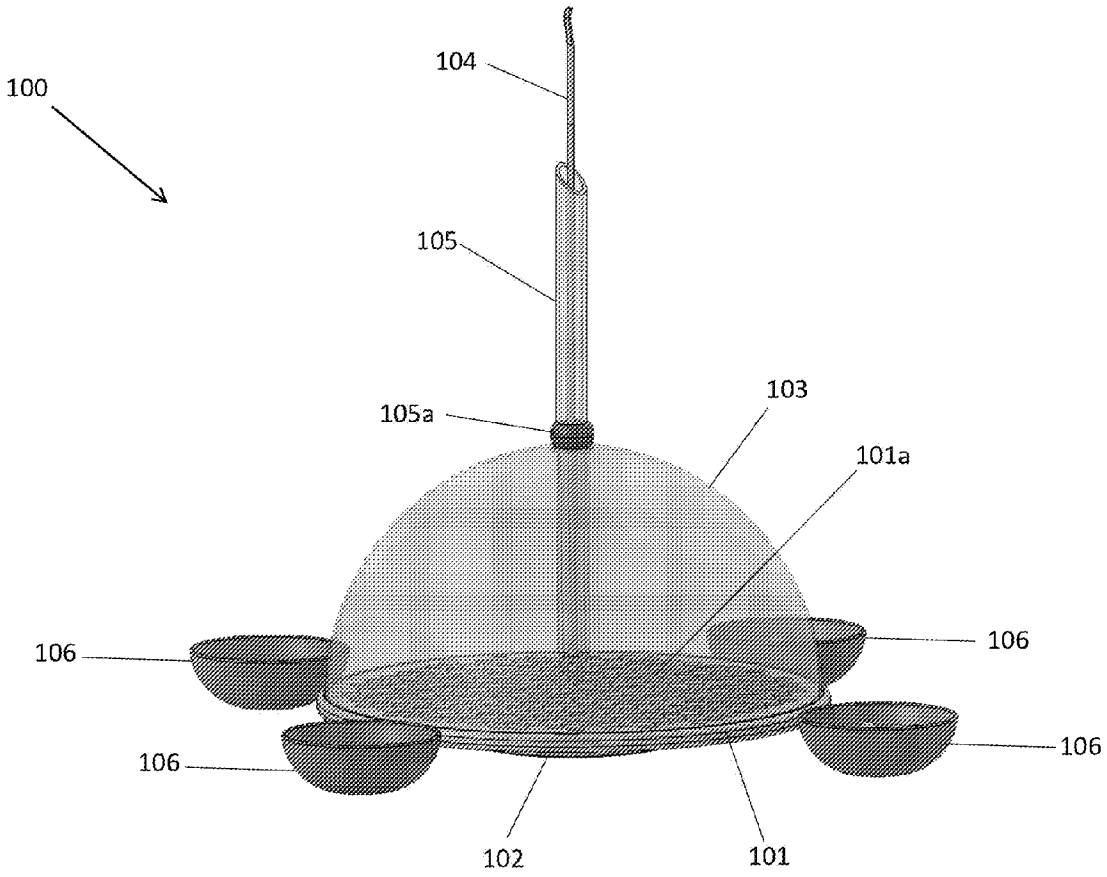
FIG. 1 schematically illustrates a perspective view of a board game apparatus, according to an embodiment of the present invention.

FIG. 1 schematically illustrates a perspective view of a board game apparatus 100, according to an embodiment of the present invention. Apparatus 100 comprises a dented platform 101 with a plurality of dents 101*a* (e.g., each of dents 101*a* may have a half-spherical form as schematically illustrated in FIG. 2B), a base 102, a transparent dome 103, an applicator 104 for manipulating corresponding game pieces (e.g., as indicated by numeral 401 in FIG. 4), and a transparent guiding tube 105 with stopper ring 105*a*. According to an embodiment of the invention, the game pieces are in form of marbles or other spherical elements that are adapted to fit into dents 101*a*. As will be appreciated by a person skilled in the art, the game pieces are scalable and can be produce in different sizes, as well as the entire structure and elements of the board game of the present invention. For example, the game pieces can be made from glass, clay, steel, plastic or agate, etc. The applicator 104 and the transparent guiding tube 105 with stopper ring 105*a* may generally refer herein as manipulating means.

According to an embodiment of the present invention, apparatus 100 is provided with a plurality of game pieces (e.g., 120 marbles) that are evenly divided into two or more groups. For example, in case of a game for up to four players, 120 marbles are divided into four groups of 30 marbles, where each 30 marbles are uniformly colored (to distinguish between each player), allowing up to four players to play by placing their marbles in turns (i.e., one marble at a time) until all marbles are placed. According to an embodiment of the invention, the winner would be the player with the longest chain/s of marbles of their color.

According to an embodiment of the invention, the game pieces can be stored in one or more dedicated storage units or containers. For example, the storage units can be in form of a round dish as indicated by numeral 106 in FIGS. 1 and 4. According to an embodiment of the invention, the board game apparatus 100 may comprise an extended supporting platform (not shown) suitable to support together the storage unit 106 as well as platform 101 and/or base 102. According to some embodiments, the storage units 106 can be detached from the extended supporting platform. For example, the containers 106 may be integrated with the dented platform by using a suitable plastic mold.

According to an embodiment of the present invention, some of the dents 101*a* which are less accessible (i.e., angle and distance wise with respect to the vertex of the transparent dome 103) are colored and a successful placement of a marble into one of these colored dents rewards the player with additional point.

One could easily appreciate the multiple different embodiments having different sizes of dented platforms, different quantities, sizing, shapes and colors of the game pieces and corresponding dents 101*a* and game rules, which can be employed to create a plurality of game plans adapting to different play time limitations, number of players and different arenas, for example a scaled up embodiment of apparatus 100 for designated tables.

Figure 2A:
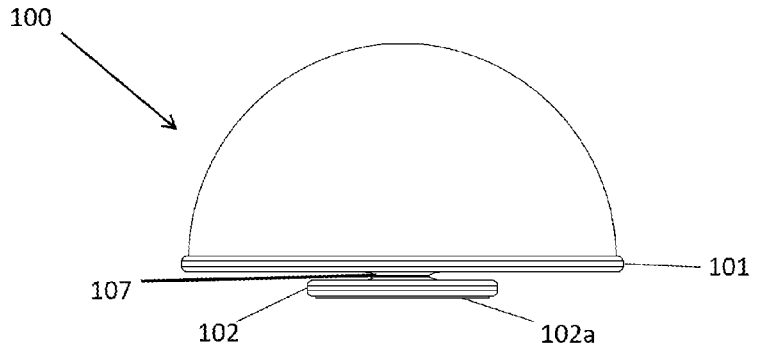
FIG. 2A schematically illustrates the structure of the board game apparatus of FIG. 1, according to an embodiment of the present invention.
Figure 2B:
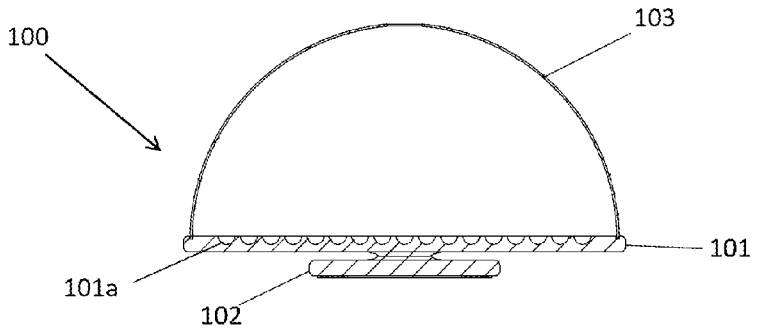
FIG. 2B illustrates a section view of the board game apparatus of FIG. 2A.

FIG. 2A schematically illustrates a side view of the structure of board game apparatus 100 (without the manipulating means), according to an embodiment of the present invention, in which platform 101 is rotatable with respect to base 102 by a rotation enabling element 107 such as a ball bearing installed between platform 101 and base 102. For example, each player around the game can rotate platform 101 to a convenient direction for performing his/her next planned manipulation. According to another embodiment of the present invention, the bottom of base 102 comprises a high friction material 102*a* such as a rubber layer, providing a firmer surface grasp and stability.

FIG. 2B schematically illustrates a section view of the structure of board game apparatus 100, according to an embodiment of the present invention, in which dents 101*a* are shown.

Figure 3A:
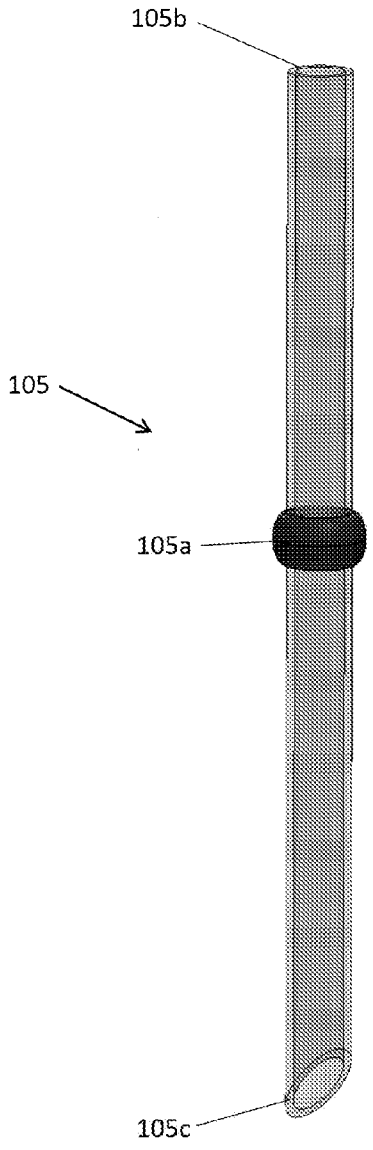
FIGS. 3A and 3B illustrate perspective views of the manipulating means, according to an embodiment of the present invention.
Figure 3B:
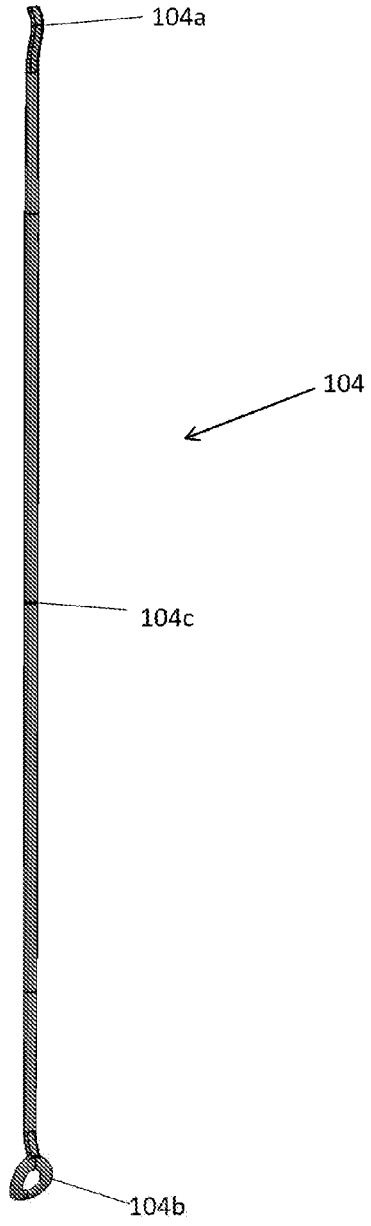

FIGS. 3A and 3B further illustrate perspective views of the manipulating means, according to an embodiment of the present invention, in which tube 105 (of FIG. 3A) is designed with port 105*b* of a straight cylindrical ending and port 105*c* of a diagonal cylindrical ending. FIG. 3B illustrates applicator 104 with curved thin tip 104*a* and concave ring tip 104*b*. For example, tip 104*a* can be employed for shifting game pieces between adjacent dents, while tip 104*b* for nesting a game piece and transporting it onto a target dent.

Figure 4:
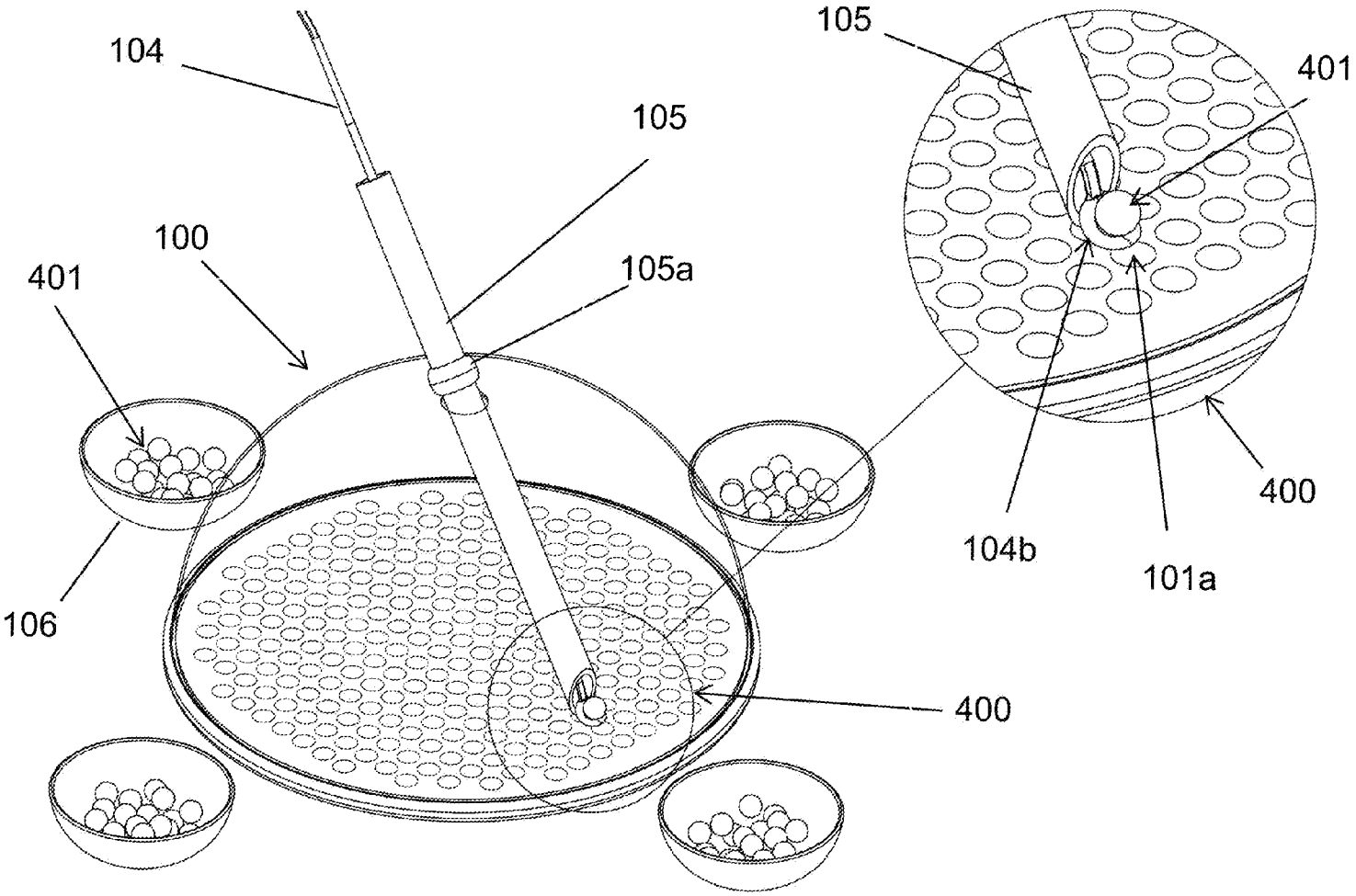
FIG. 4 is a schematic perspective view which shows a game piece approaching a dent by using the manipulating means, according to an embodiment of the present invention.

FIG. 4 is a schematic perspective view which shows a game piece 401 approaching a dent 101*a* by using the manipulating means, according to an embodiment of the present invention. FIG. 4 is a schematic perspective view which shows game piece 401 in form of a marble approaching a dent 101*a* in a position where it already exited tube 105 while nesting on tip 104*b*. A detailed zoomed view is indicated by numeral 400.

According to an embodiment of the invention, a marble (such as game piece 401) is nested in tip 104*b*, which is inserted through guiding tube 105 to approach a target dent. Stopper ring 105*a* limits the possible insertion of tube 105 through dome 103, hence the course to a desirable target dent includes a section through which the marble travels outside guiding tube 105. As noted, the player has to keep the marble nested on tip 104*b* until reaching near the desired dent without touching any marble already placed in dents). This is performed by cautiously swiveling applicator 104 inside tube 105 while directing both towards the target dent. Further manipulation is possible by preferring the insertion of tube 105 with diagonal ending port 105*c* leading, to provide longer tube support when targeting father dents (i.e., distant from the center of platform 101).

Figure 5A:
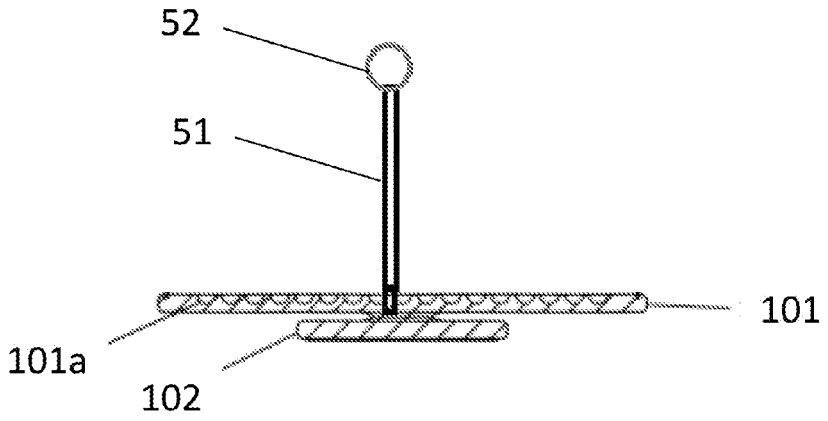
FIGS. 5A-5B schematically illustrate a board game apparatus, according to another embodiment of the invention.
Figure 5B:
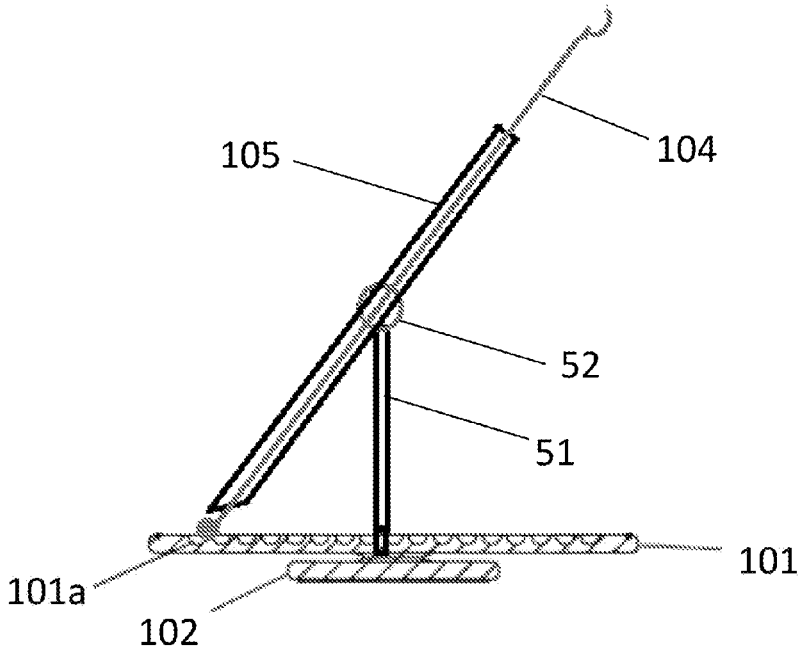
Figure 5C:
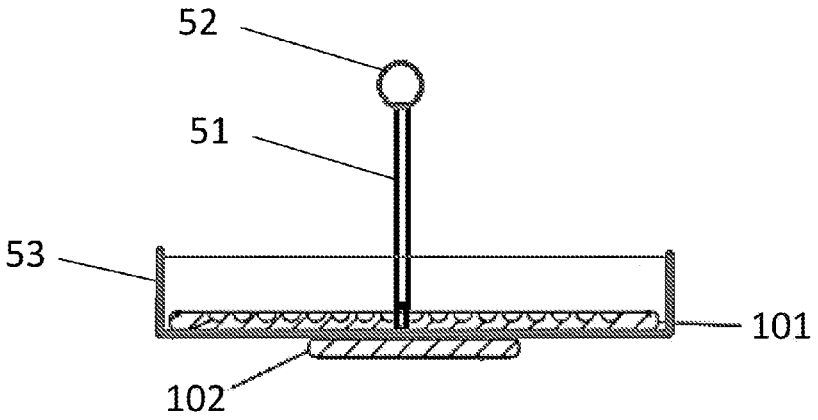
FIG. 5C schematically illustrates the board game apparatus of FIG. 5A provided with an enclosure, according to an embodiment of the invention.

Although embodiments of the invention have been described by way of illustration, it will be understood that the invention may be carried out with many variations, modifications, and adaptations, without exceeding the scope of the claims. For example, in one aspect the transparent dome may be replaced with a central pillar 51 with rotating ring 52, as schematically illustrated in FIGS. 5A-5B. In FIG. 5C the board game apparatus further comprise an enclosure as for example indicated by numeral 53. In this example, the base 102 is located under the enclosure 53. According to some embodiments of the invention, a vacuum effect formed within the transparent guiding tube is used as the applicator instead of using a physical applicator. For example, the vacuum effect can be generated by pressing on top of port 105*b* of transparent guiding tube 105 with a user's finger in a way that the finger hermetically closes port 105*b*. The generated vacuum effect causes a game piece 401 to remain static within the interior of transparent guiding tube 105, until the user removes the finger from port 105*b* (this cancels the vacuum effect and enables game piece 401 to move out of transparent guiding tube 105 via port 105*c* to the desired dent.

The invention claimed is:

1. A board game apparatus, comprising:

a. a dented platform having a plurality of dents that are adapted to receive corresponding game pieces, wherein each dent adapted to accommodate a single game piece; and b. manipulating means adapted for placing said game pieces into desirable dents, or for shifting the position of a game piece between dents, wherein the manipulating means comprises a transparent guiding tube and an applicator that is adapted to be inserted through said transparent guiding tube in order to place the game pieces into desirable dents, or to shift the position of a game piece between dents.

2. The board game apparatus of claim 1, in which the platform is essentially round and flat.

3. The board game apparatus of claim 1, in which the dents are half-spherical.

4. The board game apparatus of claim 1, in which the game pieces are spherical marbles.

5. The board game apparatus of claim 4, in which the marbles are distinguished by different colors.

6. The board game apparatus of claim 1, in which the dented platform comprises a base in which said dented platform is rotatable with respect to said base.

7. The board game apparatus of claim 6, in which a ball bearing is utilized to enable a relative rotation of the dented platform with respect to the base.

8. The board game apparatus of claim 1, in which the applicator comprises a first tip of a curved thin design and a second tip of a concave ring design.

9. The board game apparatus of claim 1, in which the transparent guiding tube comprises a first port of a straight cylindrical ending and a second port of a diagonal cylindrical ending.

10. The board game apparatus of claim 1, further comprising one or more containers for storing the game pieces.

11. The board game apparatus of claim 1, in which a suitable ending port of the transparent guiding tube is inserted first into a confined space for providing elongated securement of a traveling game piece when a target placement dent is distant from the center of the game platform.

12. The board game apparatus of claim 1, in which the game pieces are scalable and can be produced in different sizes.

13. The board game apparatus of claim 1, further comprising a transparent dome with an opening at its vertex that is adapted to cover the dented platform and to enable the insertion of game pieces into the confined space between the dented platform and said transparent dome through said opening by using the manipulation means, for placing the game pieces into desirable dents, or for shifting the position of a game piece between dents.

14. The board game apparatus of claim 1, further comprising a central pillar with a rotating ring for supporting the manipulating means for enabling the placing of game pieces into desirable dents, or for shifting the position of a game piece between dents.

15. The board game apparatus of claim 1, in which the applicator is a vacuum effect formed within the transparent guiding tube.

* * * * *